US012186621B2

(12) United States Patent
Brown

(10) Patent No.: US 12,186,621 B2
(45) Date of Patent: Jan. 7, 2025

(54) GRAVITY RESISTANCE TRAINER

(71) Applicant: APEX IP HOLDINGS, LLC, Ogden, UT (US)

(72) Inventor: Roland Brown, Ogden, UT (US)

(73) Assignee: APEX IP HOLDINGS, LLC, Ogden, UT (US)

( * ) Notice: Subject to any disclaimer, the term of this patent is extended or adjusted under 35 U.S.C. 154(b) by 142 days.

(21) Appl. No.: 17/978,863

(22) Filed: Nov. 1, 2022

(65) Prior Publication Data

US 2023/0134879 A1 May 4, 2023

Related U.S. Application Data

(60) Provisional application No. 63/274,844, filed on Nov. 2, 2021.

(51) Int. Cl.
*A63B 22/00* (2006.01)
*A63B 21/002* (2006.01)
*A63B 22/06* (2006.01)

(52) U.S. Cl.
CPC ..... *A63B 22/0012* (2013.01); *A63B 21/002* (2013.01); *A63B 22/0046* (2013.01); *A63B 2022/0635* (2013.01); *A63B 2225/093* (2013.01)

(58) Field of Classification Search
CPC ..... A63B 22/06–0694; A63B 69/10
See application file for complete search history.

(56) References Cited

U.S. PATENT DOCUMENTS 5,178,593 A * 1/1993 Roberts ..... A63B 22/0007 482/56
5,269,736 A * 12/1993 Roberts ..... A63B 23/0476 482/56
5,542,893 A * 8/1996 Petersen ..... A63B 21/157 482/62
5,601,515 A * 2/1997 Matsumoto ..... A63B 22/0605 482/57
5,840,001 A * 11/1998 Schedel ..... A61H 1/0218 606/244
5,853,353 A * 12/1998 Blumel ..... A63B 22/0605 482/142
5,857,943 A * 1/1999 Murray ..... A63B 22/0605 482/57
5,904,638 A * 5/1999 Habing ..... A63B 22/0605 482/57
5,971,894 A * 10/1999 Chen ..... A63B 22/0605 482/57

(Continued)

FOREIGN PATENT DOCUMENTS

CN 106215374 A * 12/2016

*Primary Examiner* — Nyca T Nguyen
(74) *Attorney, Agent, or Firm* — David R. Conklin; Kirton McConkie

(57) ABSTRACT

An inclined exercise apparatus may include a support frame, pedals and arm supports for a user. The angle of incline of the inclined exercise apparatus may be adjusted to be increased for a decreased level of difficulty and decreased of an increased level of difficulty. The inclined exercise apparatus may include a chest support for supporting a user's chest. The inclined exercise apparatus may include arm supports and hand grips so that a user can adjust their body position while using the inclined exercise apparatus.

14 Claims, 8 Drawing Sheets

(56) References Cited

U.S. PATENT DOCUMENTS 6,547,702 B1 * 4/2003 Heidecke ..... A63B 22/0005 482/57
7,381,164 B2 * 6/2008 Smith ..... A63B 22/16 482/73
7,399,259 B2 * 7/2008 Somwong ..... A63B 21/158 601/36
7,488,033 B1 * 2/2009 Wang ..... A63B 22/0605 297/195.11
7,494,448 B2 * 2/2009 Eschenbach ..... A63B 22/0664 482/52
7,703,845 B2 * 4/2010 Smith ..... A63B 22/00 297/215.14
8,062,190 B2 * 11/2011 Pyles ..... A63B 22/0605 482/57
8,562,491 B2 * 10/2013 Merli ..... A63B 22/06 482/52
8,647,240 B2 * 2/2014 Heidecke ..... A63B 22/0005 482/4
9,314,664 B2 * 4/2016 Villaume ..... A63B 22/0605
9,545,540 B1 * 1/2017 Moschel ..... A63B 21/0724
9,579,534 B2 * 2/2017 Sutkowski ..... H02P 9/48
10,507,354 B2 * 12/2019 Kiani ..... A63B 21/00192
10,589,148 B1 * 3/2020 Lage ..... A63B 22/0046
10,625,114 B2 * 4/2020 Ercanbrack ..... A63B 21/153
11,260,265 B2 * 3/2022 Jiang ..... A63B 23/0233
2004/0198561 A1 * 10/2004 Corbalis ..... A63B 22/0605 482/57
2007/0099764 A1 * 5/2007 Eschenbach ..... A63B 22/001 482/52
2007/0099766 A1 * 5/2007 Pyles ..... A63B 22/0605 482/57
2007/0281836 A1 * 12/2007 Gearon ..... A63B 22/0007 482/62
2009/0005223 A1 * 1/2009 Akhmetov ..... A63B 22/0023 482/52
2009/0036274 A1 * 2/2009 Greene ..... A63B 22/0605 482/57
2012/0088634 A1 * 4/2012 Heidecke ..... A63B 22/0005 482/92
2015/0141200 A1 * 5/2015 Murray ..... A63B 22/0087 482/52
2015/0165265 A1 * 6/2015 Tholkes ..... A61H 1/0262 482/57
2015/0246263 A1 * 9/2015 Campanaro ..... A63B 23/0211 482/52
2016/0346599 A1 * 12/2016 Dalebout ..... A63B 22/0605
2018/0117393 A1 * 5/2018 Ercanbrack ..... A63B 22/001
2019/0105530 A1 * 4/2019 Tholkes ..... A61G 5/14
2019/0321675 A1 * 10/2019 Wilt ..... A63B 23/0405
2020/0353310 A1 * 11/2020 Bissonnette ..... A63B 22/0005
2022/0111246 A1 * 4/2022 Ellis ..... A63B 22/205

* cited by examiner

GRAVITY RESISTANCE TRAINER

CROSS REFERENCE TO RELATED APPLICATIONS

This application claims priority from Provisional Application Ser. No. 63/274,844 filed on Nov. 2, 2021, which is hereby incorporated by reference in its entirety.

FIELD OF THE INVENTION

The described systems and methods relate to athletic training equipment.

BACKGROUND OF THE INVENTION

The health industry is a large and ever-growing industry aimed at increasing health through diet, supplements, mental health practices, and exercise. Exercise can take many forms including use of specialized personal exercise equipment that targets particular muscle groups. The benefits of exercise range from a decrease in co-morbidities, an increase in physical fitness, an increase in muscle mass, and an increase in positive mental health, among other benefits.

Individuals may seek to develop their core muscles to improve performance in sports or to increase physical fitness. Most physical activities are benefited by an increase in core strength. The core is typically defined as the abdominal and back muscles from the pelvic floor to the shoulders.

Traditional personal exercise equipment provides benefits for certain muscle groups during a given workout session. These machines sometimes, though infrequently, also provide benefits for different muscle groups in separate workout sessions. Typically, a personal exercise machine for targeting a muscle group does not also provide aerobic training. There is a long felt need among workout enthusiasts and persons of average physical fitness for a solution which provides a comprehensive full-body workout quickly and without the need for multiple types of equipment.

BRIEF SUMMARY OF THE INVENTION

The exercise apparatus described below is an effective and time-saving option for weight loss, general fitness maintenance and improvement, and the pursuit of elite fitness levels. The exercise apparatus allows for substantially increased full-body muscle utilization in a true total body workout that provides exceptional overall fitness benefits with minimal workout time requirements.

The exercise apparatus described below is fundamentally different from other exercise equipment in that it has an overall structural design change which eliminates a traditional bicycle seat and extends hand-grips and forearm cushion support structures forward to an extent which requires that the typical "vertical" and "L-shaped (recumbent)" body orientations of traditional machines is changed to a "horizontal (face down)" or "45 degree" orientation. These new body orientations require that the body be supported by the arms during cycling and that the full body musculature remain in a constant state of engagement, providing enhanced workout benefits for the total body combined with substantially reduced workout time requirements. The described exercise apparatus is a unique and hyper-efficient approach to imbuing the fitness enthusiast and person of average physical fitness with his or her maximum potential strength, flexibility and stamina utilizing a core-centric but absolutely total-body approach, achievable at an unparalleled time-to-benefit ratio.

Because of the drastically different body orientations, there are only four points of contact between the user and the exercise apparatus, namely two feet and two hands (or hands/forearms). According to some embodiments, the exercise apparatus may be used without a seat, so the full body musculature is constantly in a state of engagement. The exercise apparatus features two atypical body orientations and adjustable cycling resistance options.

The exercise apparatus described below provides an aerobic exercise experience through cycling that conditions additional muscle groups by having the user assume a unique body position, namely a horizontal or facedown position. Users of the apparatus assume a horizontal position (i.e., pushup, plank, or facedown position), the user's body is between 0 degrees and nearly 90 degrees relative to the ground, based on the user set position of the apparatus. The horizontal position exercises a user's full body by engaging muscles used to maintain the position. The degree of difficulty for the exercise apparatus can be determined by the resistance on the pedals or the angle at which the user's body is positioned relative to the ground, the lower the angle of the apparatus, the more strenuous the exercise for the user.

The present invention relates to an exercise apparatus for physical fitness. In particular, the present invention relates to an inclined exercise apparatus. In some embodiments, the inclined exercise apparatus may include a support frame.

According to some embodiments, the support frame may include a centerline in the longitudinal direction, a first horizontal support parallel to the centerline, a second horizontal support perpendicular to the centerline a third horizontal support perpendicular to the centerline, opposite the second horizontal support, a vertical diagonal member, a piston with a first end at the first horizontal support and a second end at the vertical diagonal member, and a horizontal arm rest support.

In some embodiments, the inclined exercise apparatus may include a first and second pedal perpendicular to the centerline and the second pedal opposite the first pedal. In some embodiments, the first pedal and the second pedal may be configured to operate in tandem. In some embodiments, a pedal housing may be between the first pedal and the second pedal, providing a resistance to the pedals.

In some embodiments, the inclined exercise apparatus may include a first arm support on a first end of the horizontal arm rest support and a second arm support on a second end of the horizontal arm rest support. In some embodiments, the inclined exercise apparatus may include a body support, comprising a horizontal pad supported by the diagonal member. In some embodiments, the body support supports a user's chest and may include a padding material on an upper side. In some embodiments, the body support supports a user's posterior.

In some embodiments, the first arm support and the second arm support may be disposed vertically and perpendicular to the centerline. In some embodiments, the first arm support and the second arm support may be disposed horizontally and parallel to the centerline. In some embodiments, an upper portion of the first arm support and the second arm support may be comprised of a padded material.

In some embodiments, a portion of the support frame opposite the first pedal and second pedal may be cantilevered. In some embodiments, a length of the vertical diagonal member of the support frame may be adjustable using a pin in a plurality of predefined holes in the vertical diagonal member. In some embodiments, a height of the support frame may be adjustable by the piston. In some embodiments, the piston may have a motor for raising and lowering the piston. In some embodiments, the first pedal and the second pedal may move in a circular motion. In some embodiments, the resistance of the first pedal and the second pedal may be adjustable.

In some embodiments, the inclined exercise apparatus may further comprise an information screen that may be positioned at the end of the diagonal support member opposite the first pedal and the second pedal. In some embodiments, the first arm support and second arm support may further comprise a heart rate monitor. In some embodiments, the inclined exercise apparatus may further comprise a water bottle support. In some embodiments, the first pedal and the second pedal may each have a strap.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. These drawings depict only typical embodiments of the invention and are not therefore to be considered to limit the scope of the invention.

DETAILED DESCRIPTION OF THE INVENTION

The exercise apparatus described below provides an aerobic exercise experience through cycling that conditions additional muscle groups by having the user assume a unique body position, namely a horizontal or facedown position. Users of the apparatus assume a horizontal position (i.e., pushup, plank, or facedown position), the user's body is between 0 degrees and nearly 90 degrees relative to the ground, based on the user set position of the apparatus. The horizontal position exercises a user's full body by engaging muscles used to maintain the position. The degree of difficulty for the exercise apparatus can be determined by the resistance on the pedals or the angle at which the user's body is positioned relative to the ground, the lower the angle of the apparatus, the more strenuous the exercise for the user.

The presently preferred embodiments of the present invention will be best understood by reference to the drawings, wherein like reference numbers indicate identical or functionally similar elements. It will be readily understood that the components of the present invention, as generally described and illustrated in the figures herein, could be arranged and designed in a wide variety of different configurations. Thus, the following more detailed description, as represented in the figures, is not intended to limit the scope of the invention as claimed but is merely representative of presently preferred embodiments of the invention.

Figure 1:
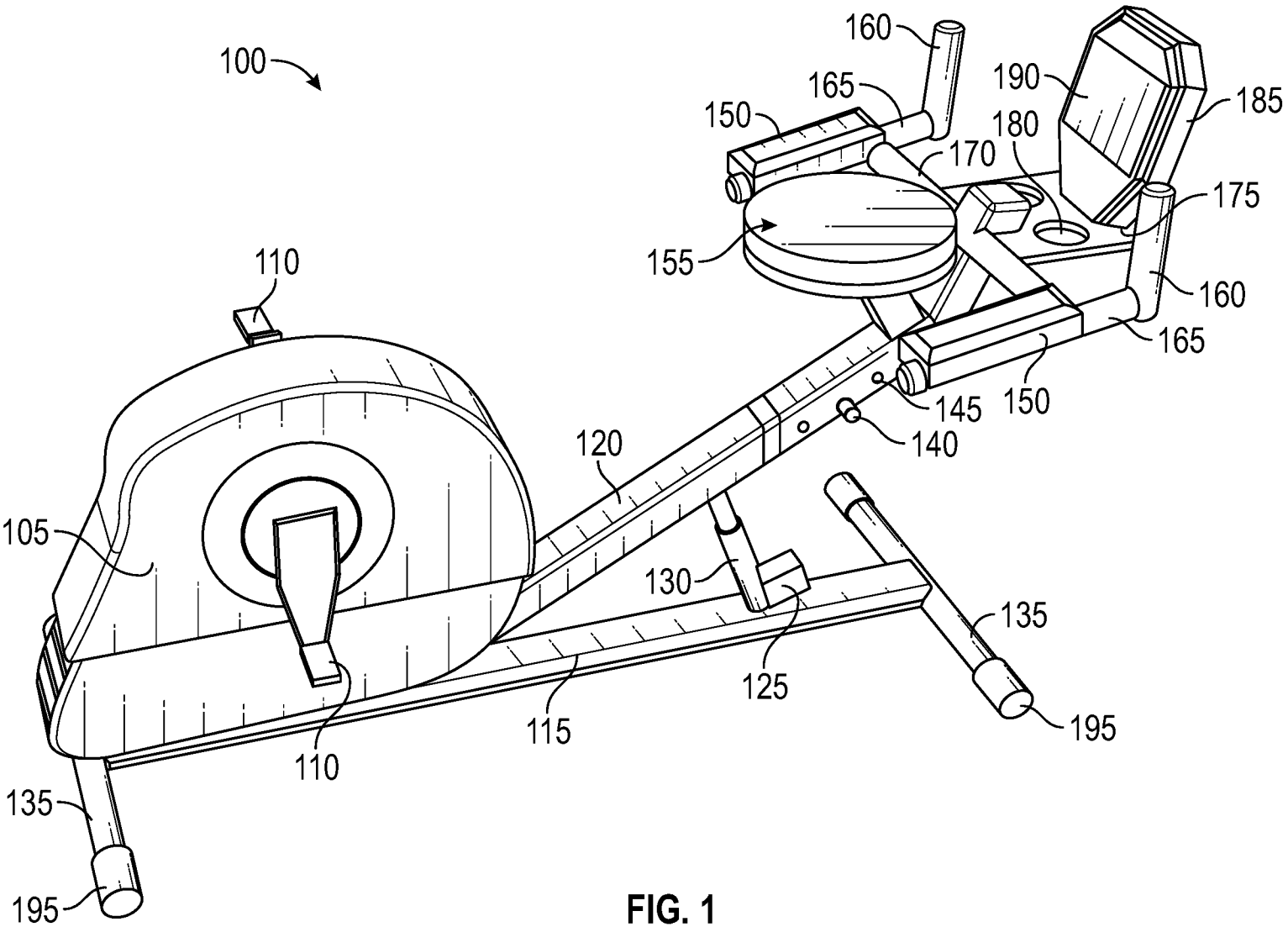
FIG. 1 is a perspective view of an example inclined exercise apparatus, according to some embodiments.

Referring now to FIG. 1, in some embodiments, the inclined exercise apparatus 100 may include a support frame. The support frame may be comprised of various elements such as a horizontal support 115 that lies on or parallel to a ground surface. The horizontal support 115 may include two perpendicular members 135 that are perpendicular to the horizontal support 115 and also lies on or parallel to the ground surface. The horizontal support 115 along with the perpendicular members 135 support the inclined exercise apparatus 100 when it is experiencing both horizontal, vertical and oblique forces from a user while the user is using the inclined exercise apparatus 100. In some embodiments, a cap 195 may be placed on the end of the perpendicular members 135. In some embodiments, the cap 195 may protect users from injury. In some embodiments, the cap 195 may provide additional stability to the inclined exercise apparatus. The cap 195 may be comprised of rubber, plastic, metal or any suitable material.

According to some embodiments, the support frame further comprises a vertical diagonal member 120. In some embodiments, the vertical diagonal member 120 extends from a first end of the horizontal support 115. In some embodiments, the vertical diagonal member 120 may intersect the horizontal support 115 proximate to a pedal housing 105. In some embodiments, the vertical diagonal member 120 may be extensible along its length. A user may extend the length of the vertical diagonal member 120 to accommodate the user's height and preferred setting for the inclined exercise apparatus 100. In some embodiments, the means for extending the vertical diagonal member 120 is a pin 140 and a plurality of holes 145. In some embodiments, a first portion of the vertical diagonal member 120 has a single hole and a second portion of the vertical diagonal member 120 has a plurality of holes 145. The single hole and the plurality of holes 145 correspond to each other. The user selects a setting where the single hole and one of the plurality of holes 145 align and then places the pin 140 through both holes thus securing the vertical diagonal member 120 at a particular length.

In some embodiments, the angle of incline of the vertical diagonal member 120 may be increased. In some embodiments, a piston 130 may be used to increase the angle of incline of the vertical diagonal member 120. The piston 130 may be embodied by any means that permits the angle of incline of the vertical diagonal member 120 to be increased or decreased. In some embodiments, the piston 130 may be coupled with a motor 125 that is configured to raise or lower the vertical diagonal member 120 automatically.

In some embodiments, a pedal housing 105 is positioned on one end of the horizontal support 115. The pedal housing 105, in some embodiments, protects the interior of the two pedals 110. The pedal housing 105 can also provide various pedal settings for the inclined exercise apparatus 100. In some embodiments, gears within the pedal housing 105 may increase or decrease resistance of the pedals 110. For example, a user may wish to have increased resistance on the pedals 110 to increase the difficulty of the user's workout. In another example, a user may choose to have decreased resistance to have a longer and more aerobic workout.

In some embodiments, the inclined exercise apparatus 100 has two pedals 110. In some embodiments, the pedals 110 are disposed opposite each other. The pedals 110 may work in tandem so that when one pedal 110 is at its highest position the other pedal 110 is at its lowest position. Both pedals 110 circle in the same direction yet on opposite ends of the circle. In some embodiments, the resistance on the pedals 110 may be increased or decreased to increase or decrease the force required to turn the pedals. An increase in the resistance of the pedals 110 may correspond to an increase in the intensity of a workout that a user may experience.

In some embodiments, a user may place their chest on the body support 155. In some embodiments, the body support 155 may be used as a safety measure to support the user's body if the user cannot maintain a horizontal position and must rest their chest on the body support 155, before use, during use or after use of the exercise apparatus 100. In some embodiments, the user maintains a position with their chest several inches above the body support 155. The body support 155 may be supported by the vertical diagonal member 120. In some embodiments, the body support 155 may be fully and directly supported by the vertical diagonal member 120 or it may be supported by another member or frame that is connected to the vertical diagonal member 120 of to another part of the support frame. In some embodiments, a user may sit on the body support 155. In some embodiments, a user may be in a sitting position but may support their body weight using their arms, so that the user's bottom is suspended above the body support 155 while the user uses the exercise apparatus 155. In some embodiments, the body support 155 may be configured to support the full body weight of a user.

In some embodiments, the inclined exercise apparatus 100 may further include devices for supporting the arms of a user. In some embodiments, a horizontal arm support may include padding 150. In some embodiments, a horizontal arm support 165 may support the forearms or the hands of a user. In some embodiments, the inclined exercise apparatus 100 may include a vertical arm support 160. A user may grasp the vertical arm support 160 with their hand while their forearm is resting on the horizontal arm support 165. In some embodiments, the vertical arm support 160 and/or the horizontal arm support 165 may include a heart rate monitoring device.

In some embodiments, the inclined exercise apparatus 100, may include a tray 175 for holding a user's belongings such as a towel, keys or a water bottle. In some embodiments, the tray 175 may include one or more water bottle openings 180. In some embodiments, the inclined exercise apparatus 100 may include a stand 185 for an information screen 190. The information screen 190 may provide a user with information such as the time elapsed, the distance traveled, the degree of resistance and any other information that a user might need while exercising.

Figure 2A:
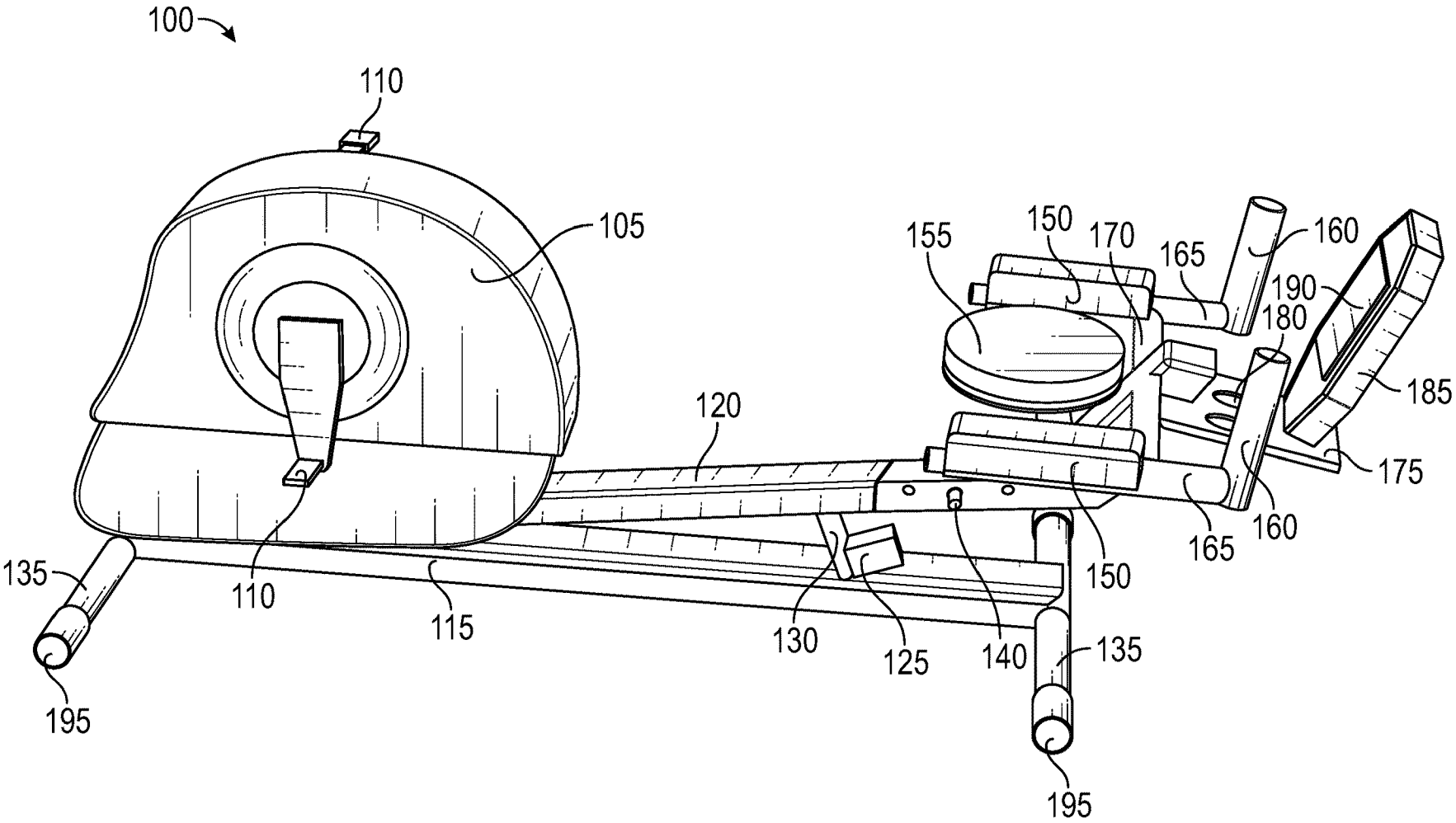
FIG. 2A is a perspective view of the example inclined exercise apparatus of FIG. 1, illustrating a first angle of incline, according to some embodiments.

Referring now to FIG. 2A, according to some embodiments, the piston 130 may be adjusted downward to its lowest setting so that the vertical diagonal member 120 is close to the ground or horizontal. The piston 130 can be adjusted manually, passively, or by the motor. According to some embodiments, the vertical diagonal member 120 may be completely horizontal when it is at its lowest setting or it may be angled slightly upwards at the lowest setting. A lower setting for the piston 130 and vertical diagonal member 120 may correspond to a more difficult workout for a user. In some embodiments, the user may face downwards with their feet on the pedals 110 and their hands on the horizontal arm support 165 or the vertical arm support 160, in this orientation the user is maintaining a plank position while using the inclined exercise apparatus 100. In some embodiments, the user may turn the pedals 110 with their feet. In some embodiments, a user may hold on to the horizontal arm support 165 and face downwards while using the inclined exercise apparatus 100. In some embodiments, the user may place their forearms on the padding 150 on the horizontal arm support 165 and place their hands on the vertical arm support 160 while using the inclined exercise apparatus 100. In some embodiments, the user may sit on the body support 155 and wrap their hands around the horizontal arm supports 165 and use the inclined exercise apparatus 100 in a manner similar to a reclined bicycle. In some embodiments, a user may be in a sitting position but may support their body weight using their arms, so that the user's bottom is suspended above the body support 155 while the user uses the exercise apparatus 155. When using the exercise apparatus 100 in this matter, the user's hands may rest on the horizontal arm supports 165.

Figure 2B:
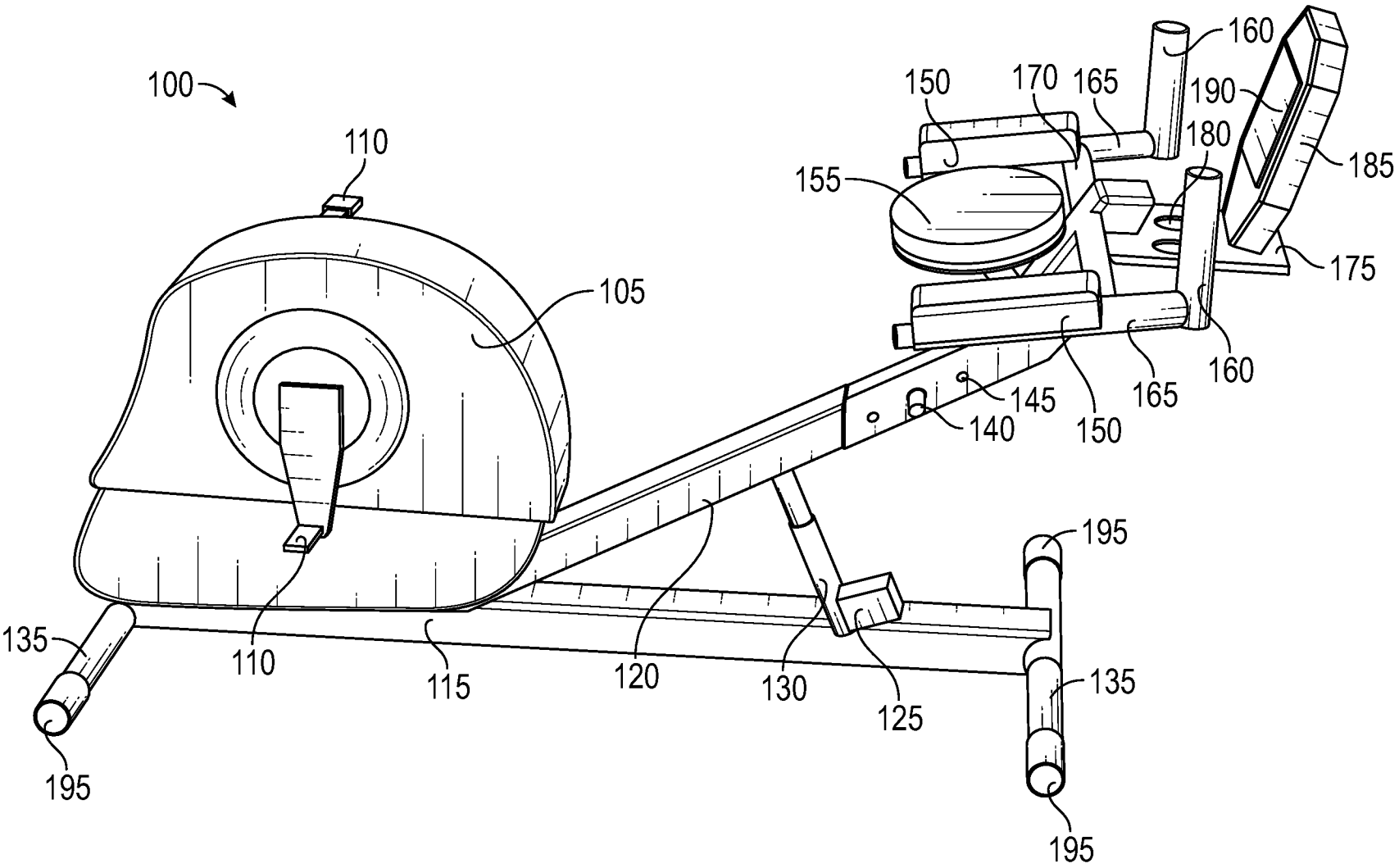
FIG. 2B is a perspective view of the example inclined exercise apparatus of FIG. 1, illustrating a second angle of incline, according to some embodiments.

Referring now to FIG. 2B, according to some embodiments, the piston 130 may be adjusted to a midway position between a lowest setting and a highest setting. The vertical diagonal member 120 may be raised to a midway position in response to the adjustment of the piston 130. A user may choose to face downwards when using the inclined exercise apparatus 100 at the position shown. A midway position for the piston 130/vertical diagonal member 120 may provide a more moderate level of difficulty of a workout for a user. The user may be in a plank position, but the plank position would not be fully horizontal or vertical. A user may experience a more moderate level of stress/workout intensity when using the inclined exercise apparatus 100 at this position.

Figure 2C:
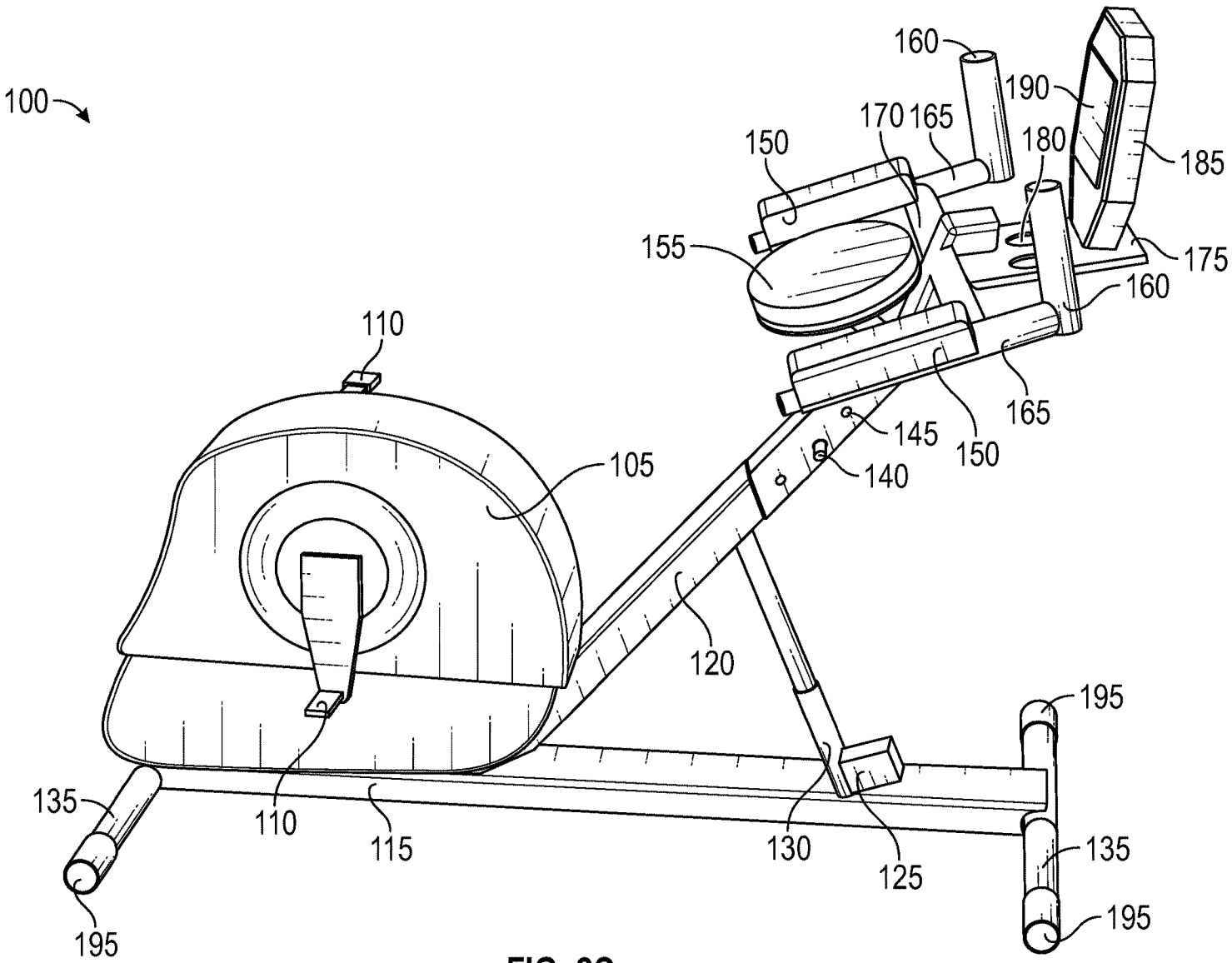
FIG. 2C is a perspective view of the example inclined exercise apparatus of FIG. 1, illustrating a third angle of incline, according to some embodiments.

Referring now to FIG. 2C, according to some embodiments, the piston 130 may be adjusted to a highest position. The vertical diagonal member 120 may be raised to a highest position in response to the adjustment of the piston 130. In some embodiments, a user may place their feet on the pedals 110 and then lean forward on to the horizontal arm supports 165 or the vertical arm supports 160. The user may be in a plank position that is more vertical than horizontal. The user would have to engage their core muscle to maintain the position even though their body position would be more inclined towards the vertical plane than the horizontal plane.

Figure 3A:
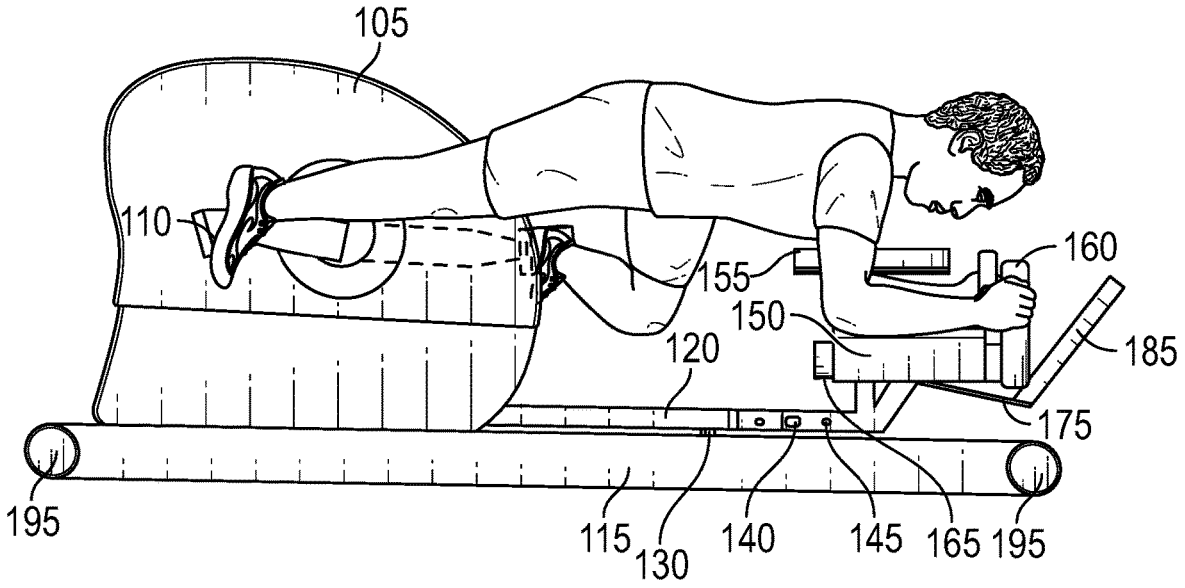
FIG. 3A is a side view of the example inclined exercise apparatus of FIG. 1, illustrating a user using the apparatus with arms in a bent position and the apparatus at a low angle of incline, according to some embodiments.

Referring now to FIG. 3A, according to some embodiments a user may lay face down over the inclined exercise apparatus 100. The user may be in a plank position. The user may lean on their forearms for support. The user's forearms may rest on the padding 150 on the horizontal arm support 165. The user may rest their chest on the body support 155. In some embodiments, the body support 155 may be used as a safety measure to support the user's body if the user cannot maintain a horizontal position and must rest their chest on the body support 155, before use, during use or after use of the exercise apparatus 100. In some embodiments, the user maintains a position with their chest several inches above the body support 155. The user's body is in a plank position with their body parallel to the ground surface and their legs outstretched. A plank position is when the user is not vertical but their body from the souls of their feet to their shoulder's is straight. The user's body weight may be supported by their arms in front and their feet in back. In some embodiments, the user is pedaling with their feet on the pedals 110 and their arms may be on the horizontal arm supports 165. The user's core muscles are engaged to keep them stabilized while the user pedals. Thus, the user may engage in a two part workout. First, the user may experience an aerobic workout from pedaling the pedals 110. Second the user may experience a strength training workout by engaging their core muscles in the plank position.

Figure 3B:
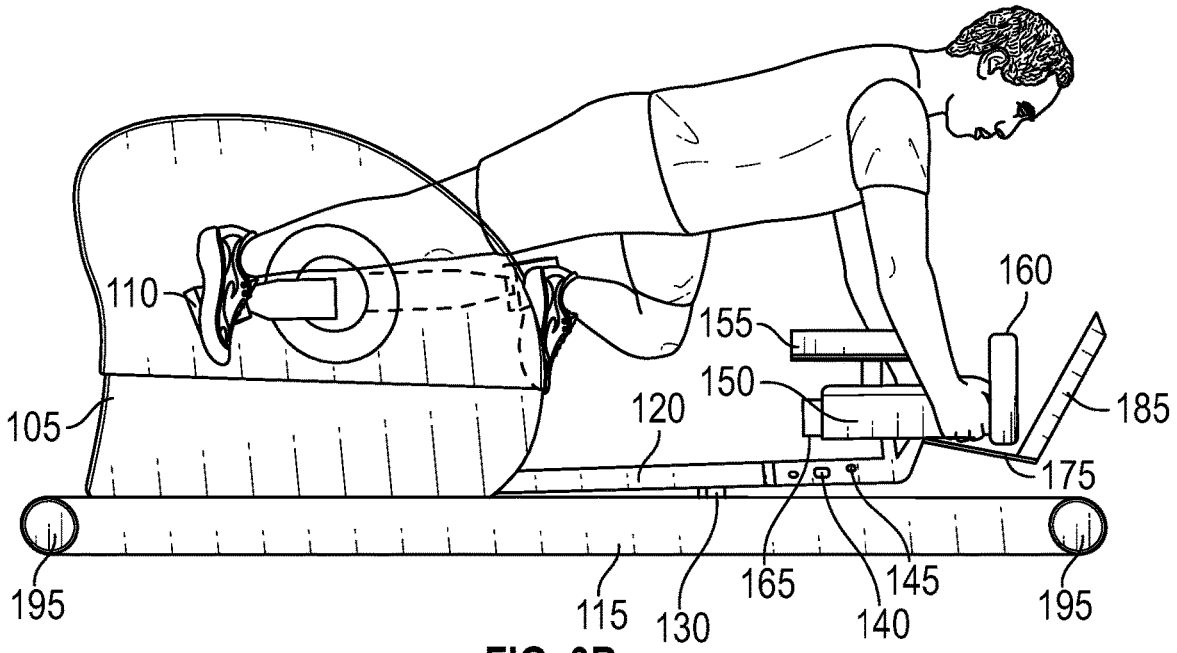
FIG. 3B is a side view of the example inclined exercise apparatus of FIG. 1, illustrating a user using the apparatus with arms in a straight position and the apparatus at a low angle of incline, according to some embodiments.

Referring now to FIG. 3B, according to some embodiments a user may lay face down over the inclined exercise apparatus 100 and the user's body may be in more of a pushup plank position. A pushup plank position is a plank position where the user's arms are outstretched perpendicular to their body. The user may support the upper portion of their body with their hands. The user may place their hands on the horizontal arm support 165. The user may experience increased intensity in their workout due to the pushup plank position. The user may place their feet on the pedals 110 and turn the pedals with their feet for an aerobic workout while maintaining the pushup plank position.

Figure 4A:
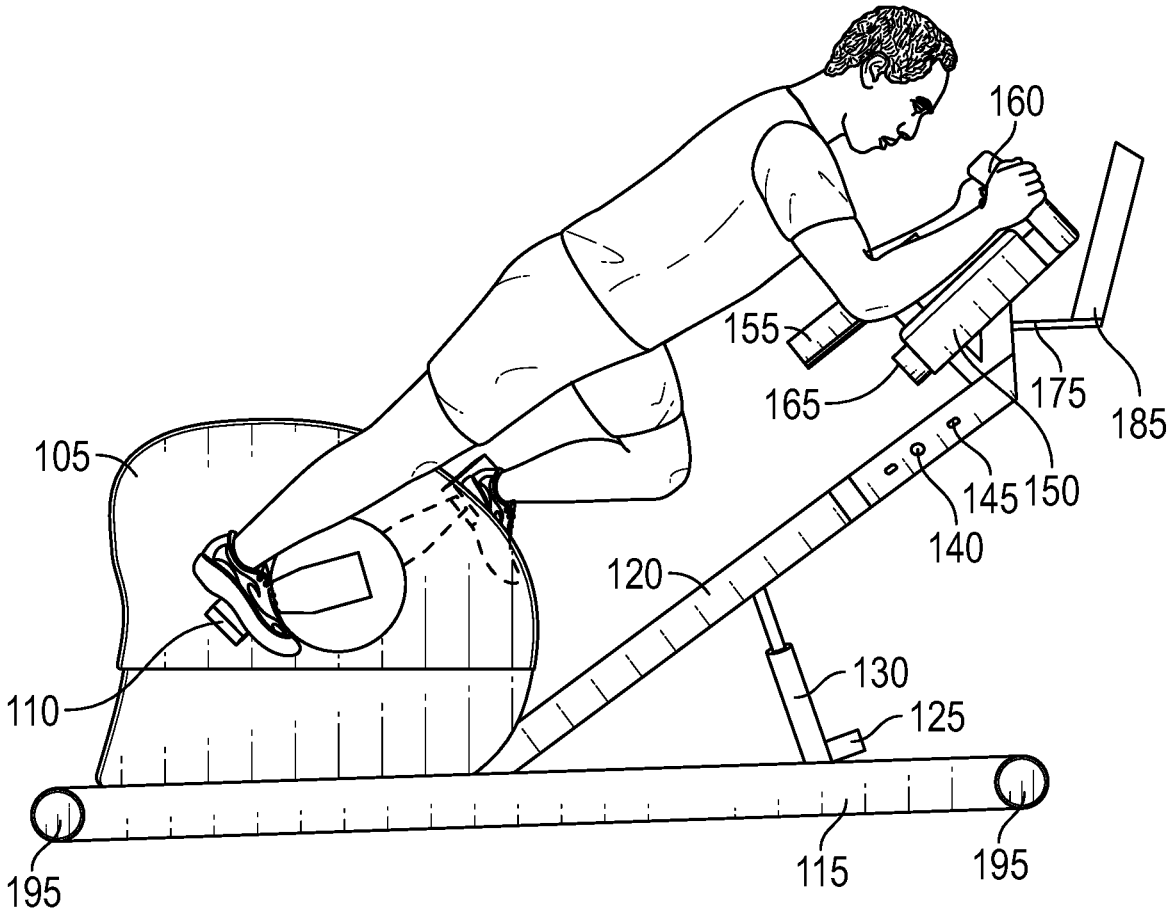
FIG. 4A is a side view of the example inclined exercise apparatus of FIG. 1, illustrating a user using the apparatus with arms in a bent position and the apparatus at a high angle of incline, according to some embodiments.

Referring now to FIG. 4A, according to some embodiments, a user may adjust the inclined exercise apparatus 100 to a middle position. The user may place their feet on the pedals 110. The user may then lean forward and may place their forearms on the horizontal arm supports 165 and their hands on the vertical arm supports 160. The user may rest their chest on the body support 155. In some embodiments, the body support 155 may be used as a safety measure to support the user's body if the user cannot maintain a horizontal position and must rest their chest on the body support 155, before use, during use or after use of the exercise apparatus 100. In some embodiments, the user maintains a position with their chest several inches above the body support 155. The user may then turn the pedals 110 with their feet. The user is pulled downwards by gravity and must resist the downward pull by engaging their core muscles and maintaining a plank position.

Figure 4B:
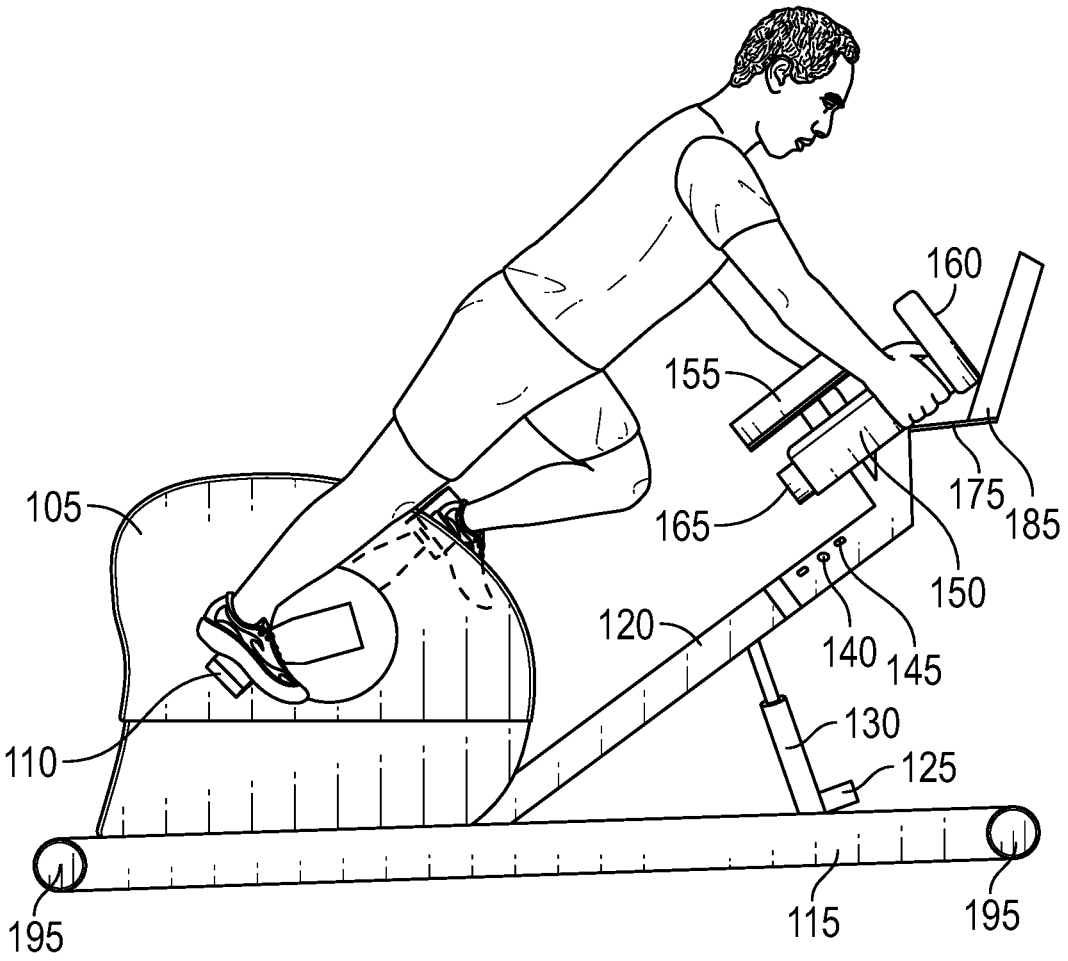
FIG. 4B is a side view of the example inclined exercise apparatus of FIG. 1, illustrating a user using the apparatus with arms in a straight position and the apparatus at a high angle of incline, according to some embodiments.

Referring now to FIG. 4B, according to some embodiments, user may use the inclined exercise apparatus 100 while in a pushup plank position with the piston 130 and the vertical diagonal member 120 extended to a middle position. The user's arms may be extended, and the user may place their hands on the horizontal arm supports 165. The user may use their feet to turn the pedals 110. The user may experience a decreased intensity to their workout because their body position is more vertical. In some embodiments, the user may experience an increased intensity to their workout because their chest is lifted off of the body support.

Figure 5:
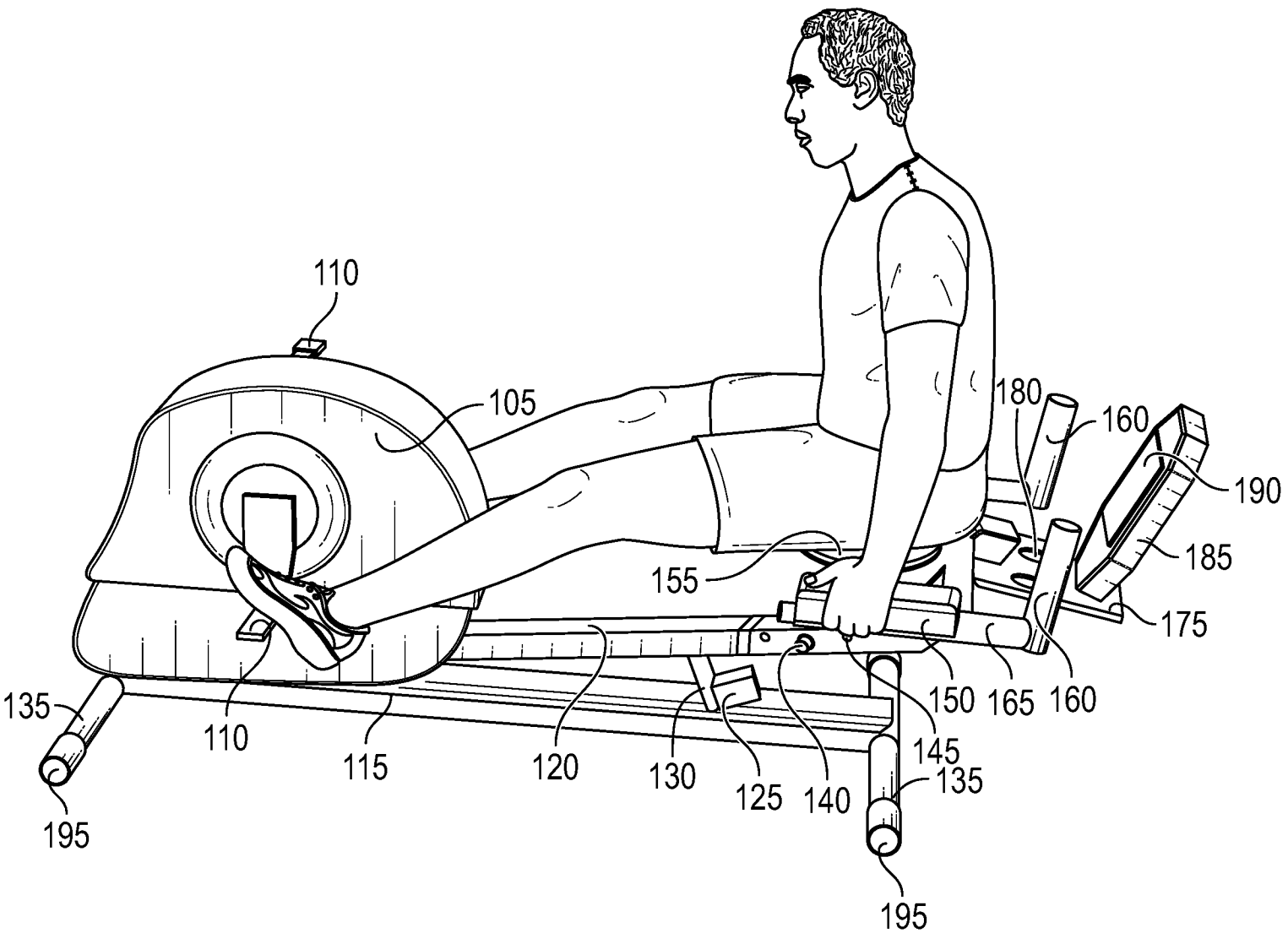
FIG. 5 is a perspective view of the example inclined exercise apparatus of FIG. 1, illustrating a user sitting on the apparatus with the apparatus at a low angle of incline, according to some embodiments.

Referring now to FIG. 5, according to some embodiments, a user may sit on the body support 155 while using the inclined exercise apparatus 100. The user may sit on the body support 155 and then extend their legs onto the pedals 110. In some embodiments, a user may choose to use the inclined exercise apparatus 100 in this position to have a less strenuous workout. In some embodiments, a user may be in a sitting position but may support their body weight using their arms, so that the user's bottom is suspended above the body support 155 while the user uses the exercise apparatus 155. The user may set the resistance for the pedals 110 to increase or decrease the intensity of their workout.

The present invention may be embodied in other specific forms without departing from its structures, methods, or other essential characteristics as broadly described herein and claimed hereinafter. Therefore, the described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. An inclined exercise apparatus, comprising:
- a support frame, comprising:
  - a centerline in the longitudinal direction;
  - a first horizontal support parallel to the centerline;
  - a second horizontal support perpendicular to the centerline;
  - a third horizontal support perpendicular to the centerline, opposite the second horizontal support;
  - a vertical diagonal member;
  - a piston with a first end at the first horizontal support and a second end at the vertical diagonal member; and
  - a horizontal arm rest support;
- a first pedal perpendicular to the centerline;
- a second pedal perpendicular to the centerline, disposed opposite the first pedal, the first pedal and second pedal configured to operate in tandem;
- a pedal housing disposed between the first pedal and the second pedal, providing a resistance to the pedals;
- a first arm support on a first end of the horizontal arm rest support;
- a second arm support on a second end of the horizontal arm rest support; and
- a body support, comprising a horizontal pad supported by the vertical diagonal member, wherein a length of the vertical diagonal member of the support frame is adjustable using a pin in a plurality of predefined holes in the vertical diagonal member.

2. The apparatus of claim 1, wherein the body support supports a user's chest, the body support further comprising a padding material on an upper side.

3. The apparatus of claim 1, wherein the body support supports a user's posterior.

4. The apparatus of claim 1, wherein the first arm support and the second arm support are disposed vertically and perpendicular to the centerline.

5. The apparatus of claim 1, wherein the first arm support and the second arm support are disposed horizontally and parallel to the centerline, wherein an upper portion of the first arm support and the second arm support is comprised of a padded material.

6. The apparatus of claim 1, wherein the vertical support member is cantilevered.

7. The apparatus of claim 1, wherein a height of the support frame is adjustable by the piston.

8. The apparatus of claim 1, wherein the first pedal and the second pedal move in a circular motion.

9. The apparatus of claim 1, wherein the resistance of the first pedal and the second pedal is adjustable.

10. The apparatus of claim 1, further comprising:
- an information screen disposed at the end of the diagonal support member opposite the first pedal and the second pedal.

11. The apparatus of claim 1, wherein the piston further comprises a motor for raising and lowering the piston.

12. The apparatus of claim 1, wherein the first arm support and second arm support further comprise a heart rate monitor.

13. The apparatus of claim 1, further comprising:

a water bottle support.

14. The apparatus of claim 1, wherein the first pedal and the second pedal each further comprise a strap.

* * * * *